US007025071B1

(12) United States Patent
Fenderson

(10) Patent No.: US 7,025,071 B1
(45) Date of Patent: Apr. 11, 2006

(54) OSCILLATING MACHINE FOR WASHING TRAYS

(76) Inventor: Wayne Fenderson, 200 Central Ave., Apt. B-6, Lawrence, NY (US) 11559

( * ) Notice: Subject to any disclaimer, the term of this patent is extended or adjusted under 35 U.S.C. 154(b) by 551 days.

(21) Appl. No.: 10/335,636

(22) Filed: Dec. 31, 2002

(51) Int. Cl.
*B08B 3/00* (2006.01)

(52) U.S. Cl. ..... 134/56 R; 134/57 D; 134/84; 134/85; 134/117; 134/118; 134/119

(58) Field of Classification Search ..... 134/137, 134/140, 142, 153, 157, 164
See application file for complete search history.

(56) References Cited

U.S. PATENT DOCUMENTS 3,072,128 A * 1/1963 James ..... 134/57 D
3,773,058 A 11/1973 Kitterman et al.
3,779,258 A 12/1973 Brenner et al.
3,798,065 A 3/1974 Kitterman et al.
3,939,854 A 2/1976 Kitterman et al.
3,990,571 A 11/1976 Kitterman et al.
4,021,266 A 5/1977 Kitterman et al.
4,175,575 A 11/1979 Cushing
5,027,840 A * 7/1991 Nezworski ..... 134/57 D
5,526,835 A 6/1996 Olechow
2004/0112520 A1* 6/2004 Hanschen et al. ..... 156/277

* cited by examiner

*Primary Examiner*—Michael Barr
*Assistant Examiner*—Rita R. Patel
(74) *Attorney, Agent, or Firm*—Richard L. Miller

(57) ABSTRACT

An oscillating machine for washing trays. The machine includes a housing, a frame, a water system, and an air system. The frame is oscillatingly mounted in the housing and holds the trays to be washed. The water system is contained in the housing and supplies water to wash the trays. The air system is contained in the housing and supplies air to dry the trays.

20 Claims, 2 Drawing Sheets

OSCILLATING MACHINE FOR WASHING TRAYS

BACKGROUND OF THE INVENTION

1. Field of the Invention

The present invention relates to an oscillating machine. More particularly, the present invention relates to an oscillating machine for washing trays.

2. Description of the Prior Art

Numerous innovations for washing systems have been provided in the prior art that will be described. Even though these innovations may be suitable for the specific individual purposes to which they address, however, they differ from the present invention.

A FIRST EXAMPLE, U.S. Pat. No. 3,773,058 to Kitterman et al. teaches a tray washing system that includes conveyors which transport compartmented food service trays from a tray receiving mechanism to inverting and scrapping mechanisms and through washing, rinsing and drying mechanisms to a stacking mechanism. The receiving mechanism restricts trays to insertion in a predetermined orientation in which the food receiving surfaces face upwardly, and the inverting mechanism inverts each tray so that the food receiving surface faces downwardly. As each tray is inverted, the scrapping mechanism discharges substantially the entire contents of a cleaning fluid reservoir onto the food receiving surface of the tray, and thereby dislodges refuse and silverware that may be on the tray. The washing, rinsing and drying mechanism apply a water-detergent solution, rinse water, and drying air to the trays, respectively, and the stacking mechanism deposits the trays onto a mobile self-depressing tray receiver. The tray washing system further includes a silverware separating and soaking mechanism comprising a chute which receives cleaning fluid and refuse and silverware entrained therein, a dam which removes the heavier silverware from the cleaning fluid, and a door in the bottom of the chute for dripping the silverware into a soaking sink.

A SECOND EXAMPLE, U.S. Pat. No. 3,779,258 to Brenner et al. teaches a dishwasher having a holder for holding silverware to be washed rotatably mounted on a dish holding rack in the washing chamber. The silverware basket is rotated on the dish holding rack so as to permit subjecting silverware carried thereby to a spray of washing liquid, with the spray striking the silverware in different angular positions as the silverware basket revolves. The spray itself may have movement relative to the dish holding rack and silverware holding basket, and in the illustrated embodiment is provided by a rotating spray arm. Further, in the illustrated embodiment, the rotation of the silverware basket is effected by a supplemental spray acting against vanes on the rotatable silverware basket.

A THIRD EXAMPLE, U.S. Pat. No. 3,798,065 to Kitterman et al. teaches a tray washing system that includes conveyors which transport compartmented food service trays from a tray receiving mechanism to inverting and scrapping mechanisms and through washing, rinsing and drying mechanisms to a stacking mechanism. The receiving mechanism restricts trays to insertion in a predetermined orientation in which the food receiving surfaces face upwardly, and the inverting mechanism inverts each tray so that the feed receiving surface faces downwardly. As each tray is inverted, the scrapping mechanism discharges substantially the entire contents of a cleaning fluid reservoir onto the food receiving surface of the tray, and thereby dislodges refuse and silverware that may be on the tray. The washing, rinsing and drying mechanism apply a water-detergent solution, rinse water, and drying air to the trays, respectively, and the stacking mechanism deposits the trays onto a mobile self-depressing tray receiver. The tray washing system further includes a silverware separating and soaking mechanism comprising a chute which receives cleaning fluid and refuse and silverware entrained therein, a dam which removes the heavier silverware from the cleaning fluid, and a door in the bottom of the chute for dropping the silverware into a soaking sink.

A FOURTH EXAMPLE, U.S. Pat. No. 3,939,854 to Kitterman et al. teaches a tray washing system includes conveyors which transport compartmented food service trays from a tray receiving mechanism to inverting and scrapping mechanisms and through washing, rinsing and drying mechanisms to a stacking mechanism. The receiving mechanism restricts trays to insertion in a predetermined orientation in which the food receiving surfaces face upwardly, and the inverting mechanism inverts each tray so that the food receiving surface faces downwardly. As each tray is inverted, the scrapping mechanism discharges substantially the entire contents of a cleaning fluid reservoir onto the food receiving surface of the tray, and thereby dislodges refuse and silverware that may be on the tray. The washing, rinsing and drying mechanism apply a water-detergent solution, rinse water, and drying air to the trays, respectively, and the stacking mechanism deposits the trays onto a mobile self-depressing tray receiver. The tray washing system further includes a silverware separating and soaking mechanism comprising a chute which receives cleaning fluid and refuse and silverware entrained therein, a dam which removes the heavier silverware from the cleaning fluid, and a door in the bottom of the chute for dropping the silverware into a soaking sink.

A FIFTH EXAMPLE, U.S. Pat. No. 3,990,571 to Kitterman et al. teaches a tray washing system that includes conveyors which transport compartmented food service trays from a tray receiving mechanism to inverting and scrapping mechanisms and through washing, rinsing and drying mechanisms to a stacking mechanism. The receiving mechanism restrict trays to insertion in a predetermined orientation in which the food receiving surfaces face upwardly, and the inverting mechanism inverts each tray so that the food receiving surface faces downwardly.

A SIXTH EXAMPLE, U.S. Pat. No. 4,021,266 to Kitterman et al. teaches a tray washing system that includes conveyors which transport compartmented food service trays from a tray receiving mechanism to inverting and scrapping mechanisms and through washing, rinsing and drying mechanisms to a stacking mechanism. The receiving mechanism restricts trays to insertion in a predetermined orientation in which the food receiving surfaces face upwardly, and the inverting mechanism inverts each tray so that the food receiving surface faces downwardly. As each tray is inverted, the scrapping mechanism discharges substantially the entire contents of a cleaning fluid reservoir onto the food receiving surface of the tray, and thereby dislodges refuse and silverware that may be on the tray. The washing, rinsing and drying mechanism apply a water-detergent solution, rinse water, and drying air to the trays, respectively, and the stacking mechanism deposits the trays onto a mobile self-depressing tray receiver. The tray washing system further includes a silverware separating and soaking mechanism comprising a chute which receives cleaning fluid and refuse and silverware entrained therein, a dam which removes the heavier silverware from the cleaning fluid, and a door in the bottom of the chute for dropping the silverware into a soaking sink.

A SEVENTH EXAMPLE, U.S. Pat. No. 4,175,575 to Cushing teaches an arrangement for oscillating a rotating dishwasher spray arm about its longitudinal axis to direct the Jet sprays at the dishware items at various differing angles including forward, reverse and vertical inclinations to increase coverage and to improve the jet spray washing action by reducing shadowing. The oscillation is produced by a drive gear and crank mechanism driven by a fixed reaction gear as the spray arm rotates. Jet reaction forces are utilized to rotate the spray arm and are related with respect to the axis of rotation of the spray arm so that the resultant torque causing rotation of the spray arm does not significantly vary as the spray arm is oscillated to insure the proper rotational speed of the spray arm. The frequency of oscillation relative to the frequency of rotation is selected to be such that a number of differing jet spray angles are produced for each rotational position of the spray arm in successive revolutions thereof to minimize shadowing effects. Particular mounting details for the spray arm accommodate the simultaneous rotation and oscillation and allow the supply of washing liquid via the mounting structure.

AN EIGHTH EXAMPLE, U.S. Pat. No. 5,526,835 to Olechow teaches a fluid spray jet drive system for a rotatably mounted turntable which include a plurality of closely spaced, radially extending vanes depending from the turntable. A fluid spray jet is disposed below the turntable. The spray jet is substantially vertically aligned thereby directing a jet fluid substantially vertically at the vanes. The fluid jet drive system, as described, provides a positive drive for slow rotation.

It is apparent that numerous innovations for washing systems have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an oscillating machine for washing trays that avoids the disadvantages of the prior art.

ANOTHER OBJECT of the present invention is to provide an oscillating machine for washing trays that is simple to use.

BRIEFLY STATED, STILL ANOTHER OBJECT of the present invention is to provide an oscillating machine for washing trays. The machine includes a housing, a frame, a water system, and an air system. The frame is oscillatingly mounted in the housing and holds the trays to be washed. The water system is contained in the housing and supplies water to wash the trays. The air system is contained in the housing and supplies air to dry the trays.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
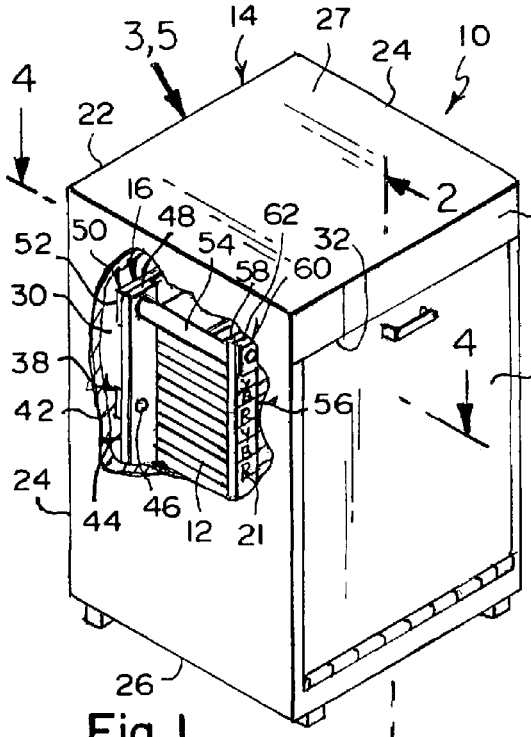
FIG. 1 is a diagrammatic perspective view of the present invention.

10 oscillating machine of present invention for washing trays 12
12 trays
14 housing
16 frame for holding trays 12 to be washed
18 water system for supplying water to wash trays 12
20 air system for supplying air to dry trays 12
21 color indicia coding
22 rear wall of housing 14
24 pair of side walls of housing 14
26 bottom wall of housing 14
27 top wall of housing 14
28 front wall of housing 14
30 interior of housing 14
31 door of housing 14
32 opening in front wall 28 of housing 14
34 first strip of frame 16
36 pair of ends of first strip 34 of frame 16
38 pair of second strips of frame 16
40 midpoint of each second strip of pair of second strips 38 of frame 16
42 pair of ends of each second strip of pair of second strips 38 of frame 16
44 pair of third strips of frame 16
46 pair of intermediate points 46 of each of third strip of pair of third strips 44 of frame 16
48 pair of ends of each of third strip of pair of third strips 44 of frame 16
50 pair of fourth strips of frame 16
52 pair of ends of each fourth strip of pair of fourth strips 50 of frame 16
54 two pair of rods of frame 16
56 pair of fifth strips of frame 16
58 pair of ends of each fifth strip of pair of fifth strips 56
60 pair of sixth strips of frame 16
62 pair of ends of each sixth strip of pair of sixth strips 60 of frame 16
64 motor of frame 16
66 crank of frame 16

First Embodiment Of Water System 18

68 water pump of water system 18 for pumping heated water so as to form pumped heated water

70 water heater of water system 18 for fluidly communicating with source of water for heating water so as to form heated water

72 manifold of water system 18 for conducting pumped heated water so as to form conducted pumped heated water

74 spray heads of water system 18 for spraying conducted pumped heated water

78 air blower of air system 20 for blowing air so as to form blown air

80 manifold of air system 20 for conducting blown air

82 orifices in manifold 80 of air system 20 for exiting blown air

84 microprocessor

Second Embodiment Of Water System 118

118 water system for supplying water to wash trays 12

172 manifold

174 spray heads

DETAILED DESCRIPTION OF THE PREFERRED EMBODIMENT

Figure 2:
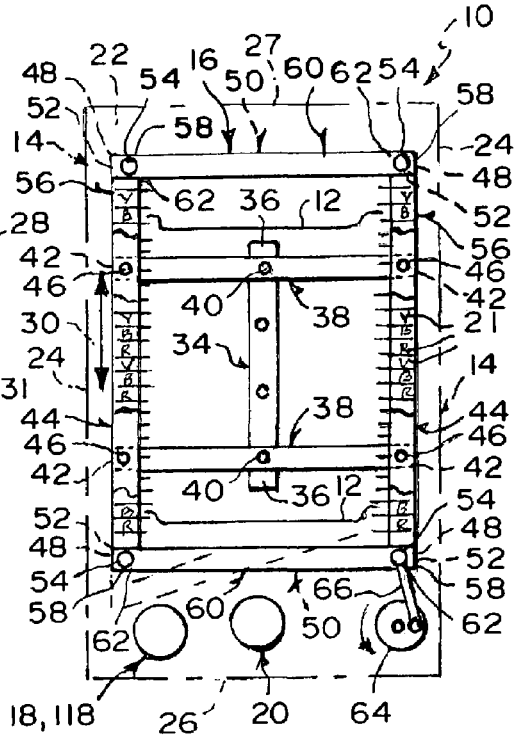
FIG. 2 is a diagrammatic cross sectional view taken along line 2—2 in FIG. 1.

Referring now to the figures, in which like numerals indicate like parts, and particularly to FIGS. 1 and 2, the oscillating machine of the present invention is shown generally at 10 for washing trays 12.

The oscillating machine 10 comprises a housing 14, a frame 16, a water system 18, and an air system 20. The frame 16 is oscillatingly mounted in the housing 14 and is for holding the trays 12 to be washed. The water system 18 is contained in the housing 14 and is for supplying water to wash the trays 12. The air system 20 is contained in the housing 14 and is for supplying air to dry the trays 12.

Color indicia coding 21, best seen in FIG. 2, typically indicated by R for red, B for blue, and Y for yellow is provided on the frame at appropriate position for facilitating aligning the trays 12 properly when installing the tray in the frame 16. This color coding is especially helpful should the frame be in a tilted orientation.

The housing 14 is generally rectangular-parallelepiped-shaped, has a rear wall 22, a pair of side walls 24, a bottom wall 26, a top wall 26, a front wall 28, an interior 30, and a door 31. The front wall 28 of the housing 14 has an opening 32 therein that communicates with the interior 30 thereof. The door 31 of the housing 14 is hingedly attached to the front wall 28 thereof and selectively closes the opening 32 in the front wall 28 thereof.

The specific configuration of the frame 16 can best be seen in FIG. 2, and as such, will be discussed with reference thereto.

The frame 16 is oscillatingly attached to the rear wall 22 of the housing 14 by a first strip 34. The first strip 34 of the frame 16 is vertically attached to the rear wall 22 of the housing 14, and has a pair of ends 36.

The frame 16 further has a pair of second strips 38. Each of the second strips 38 has a midpoint 40 that is pivotally attached to a respective end 36 of the first strip 34 so as to form a first pivot point, and a pair of ends 42.

The frame 16 further has a pair of third strips 44. Each of the third strips 44 has a pair of intermediate points 46 that are pivotally attached to a pair of adjacent ends 42 of the pair of second strips 38 so as to form a pair of second pivot points, and a pair of ends 48.

The frame 16 further has a pair of fourth strips 50. Each fourth strip 50 has a pair of ends 52 that are pivotally attached to a pair of adjacent ends 48 of the pair of third strips 44 so as to form a pair of third pivot points, and in doing so, forms a rectangle that is deformable into a parallelogram about the pair of first pivot points.

The frame 16 further has two pair of rods 54. The two pair of rods 54 extend forwardly from the third pivot points, respectively.

The frame 16 further has a pair of fifth strips 56. Each fifth strip 56 is parallel to, and spaced in front of, an adjacent third strip 44, and has a pair of ends 58.

The frame 16 further has a pair of sixth strips 60. Each sixth strip 60 is parallel to, and spaced in front of, an adjacent fourth strip 50, and has a pair of ends 62 that are pivotally attached to a pair of adjacent ends 58 of the pair of fifth strips 56 so as to form a rectangle that is deformable into a parallelogram.

The frame 16 further has a motor 64. The motor 64 is contained in the interior 30 of the housing 14, is mounted to the bottom wall 26 of the housing 14, and is operatively connected to the frame 16 by a crank 66. The crank 66 causes the frame 16 to oscillate about the pair of first pivot points when the motor 64 is activated.

Figure 3:
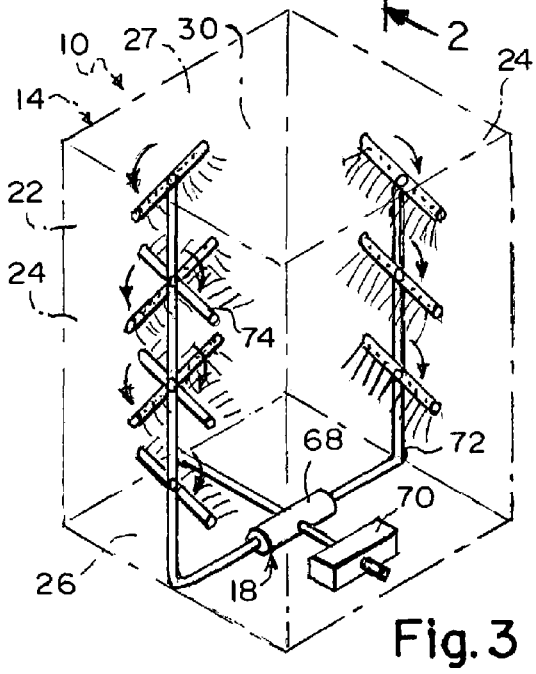
FIG. 3 is a diagrammatic perspective view of the area generally identified by arrow 3 in FIG. 1 of a first embodiment of the water system of the present invention.

The specific configuration of a first embodiment of the water system 18 can best be seen in FIG. 3, and as such, will be discussed with reference thereto.

The water system 18 comprises a water pump 68, a water heater 70, a manifold 72, and spray heads 74.

The water heater 70 is contained in the interior 30 of the housing 14, is mounted to the bottom wall 26 of the housing 14, and is for fluidly communicating with a source of water for heating the water so as to form heated water.

The water pump 68 is contained in the interior 30 of the housing 14, is mounted to the bottom wall 26 of the housing 14, is in fluid communication with the water heater 70, and is for pumping the heated water so as to form pumped heated water.

The manifold 72 fluidly communicates with the water pump 68, is contained in the interior 30 of the housing 14, extends laterally along the bottom wall 26 of the housing 14 and along the side walls of the housing 14, and is for conducting the pumped heated water so as to form conducted pumped heated water.

The spray heads 74 fluidly communicate with, and are operatively connected to, the manifold 72, are contained in the interior 30 of the housing 14, and are for spraying the conducted pumped heated water.

The spray heads 74 are rotatively connected to the manifold 72.

Figure 4:
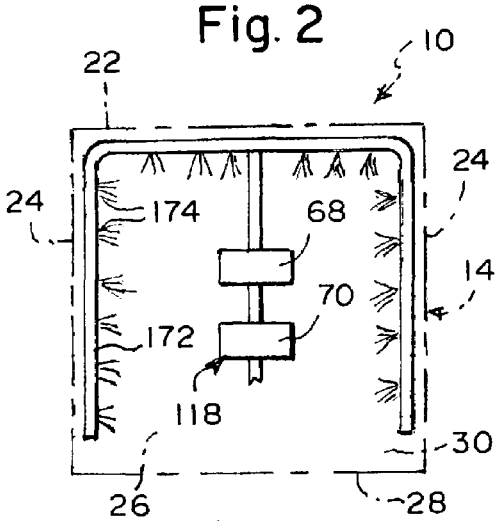
FIG. 4 is a diagrammatic cross sectional view, taken along line, 4—4 in FIG. 1 of a second embodiment of the water system of the present invention.

The specific configuration of a second embodiment of the water system 118 can best be seen in FIG. 4, and as such, will be discussed with reference thereto.

The water system 118 is similar to the water system 18, except the spray heads 174 are fixedly connected to the manifold 172.

Figure 5:
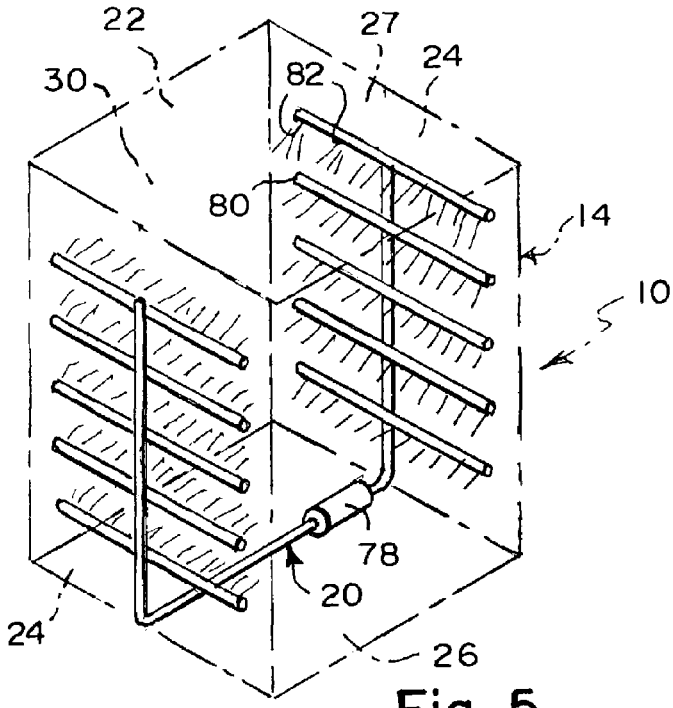
FIG. 5 is a diagrammatic perspective view of the area generally identified by arrow 5 in FIG. 1 of the air system of the present invention.

The specific configuration of the air system 20 can best be seen in FIG. 5, and as such, will be discussed with reference thereto.

The air system 20 comprises an air blower 78 and a manifold 80. The air blower 78 is contained in the interior 30 of the housing, is mounted to the bottom wall 26 of the housing 14, and is for blowing air so as to form blown air.

The manifold 80 fluidly communicates with the air blower 78, is contained in the interior 30 of the housing 14, extends laterally along the bottom wall 26 of the housing 14 and along the side walls 24 of the housing 14, is for conducting the blown air, and has orifices 82 for exiting the blown air.

Figure 6:
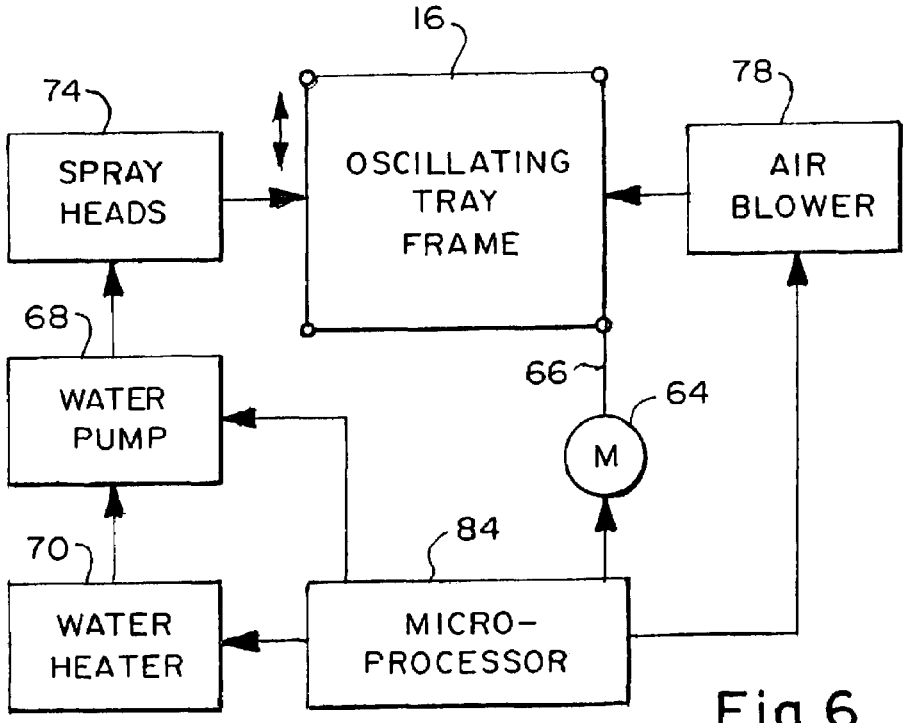
FIG. 6 is a block diagram of the present invention.

As shown in FIG. 6, the oscillating machine 10 further comprises a microprocessor 84. The microprocessor controls the water heater 70, the water pump 68, the motor 64, and the air blower 78.

It will be understood that each of the elements described above, or two or more together, may also find a useful application in other types of constructions differing from the types described above.

While the invention has been illustrated and described as embodied in an oscillating machine for washing trays, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An oscillating machine for washing trays, comprising:

a) a housing;

b) a frame;

c) a water system; and d) an air system;

wherein said frame is oscillatingly mounted in said housing;

wherein said frame is for holding the trays to be washed;

wherein said water system is contained in said housing;

wherein said water system is for supplying water to wash the trays;

wherein said air system is contained in said housing; and wherein said air system is for supplying air to dry the trays, wherein said housing is generally rectangular-parallelepiped-shaped;

wherein said housing has a rear wall;

wherein said housing has a pair of side walls;

wherein said housing has a bottom wall;

wherein said housing has a top wall;

wherein said housing has a front wall;

wherein said housing has an interior;

wherein said housing has a door;

wherein said front wall of said housing has an opening therein;

wherein aid opening in said front wall of said housing communicates with said interior thereof;

wherein said door of said housing is hingedly attached to said front wall thereof; and wherein said door of said housing selectively closes said opening in said front wall thereof, wherein said frame is oscillatingly attached to said rear wall of said housing by a first strip, wherein said first strip of said frame is vertically attached to said rear wall of said housing; and wherein said first strip of said frame has a pair of ends.

2. The machine as defined in claim 1, wherein said frame has a pair of second strips;

wherein each of said second strips has a midpoint;

wherein said midpoint of each of said second strips is pivotally attached to a respective end of said first strip so as to form a first pivot point; and wherein each of said second strips has a pair of ends.

3. The machine as defined in claim 2, wherein said frame has a pair of third strips;

wherein each of said third strips has a pair of intermediate points;

wherein said pair of intermediate points of each of said third strips are pivotally attached to a pair of adjacent ends of said pair of second strips so as to form a pair of second pivot points; and wherein each of said third strips has a pair of ends.

4. The machine as defined in claim 3, wherein said frame has a pair of fourth strips;

wherein each fourth strip has a pair of ends; and wherein said pair of ends of each fourth strip are pivotally attached to a pair of adjacent ends of said pair of third strips so as to form a pair of third pivot points, and in doing so, forms a rectangle that is deformable into a parallelogram about said pair of first pivot points.

5. The machine as defined in claim 4, wherein said frame has two pair of rods; and wherein said two pair of rods extend forwardly from said third pivot points, respectively.

6. The machine as defined in claim 5, wherein said frame has a pair of fifth strips;

wherein each fifth strip is parallel to an adjacent third strip;

wherein each fifth strip is spaced in front of said adjacent third strip; and wherein each fifth strip has a pair of ends.

7. The machine as defined in claim 6, wherein said frame has a pair of sixth strips;

wherein each sixth strip is parallel to an adjacent fourth strip;

wherein each sixth strip is spaced in front of said adjacent fourth strip;

wherein each sixth strip has a pair of ends; and wherein said pair of ends of each sixth strip are pivotally attached to a pair of adjacent ends of said pair of fifth strips so as to form a rectangle that is deformable into a parallelogram.

8. The machine as defined in claim 2, wherein said frame has a motor;

wherein said motor is contained in said interior of said housing;

wherein said motor is mounted to said bottom wall of said housing;

wherein said motor is operatively connected to said frame by a crank; and wherein said crank causes said frame to oscillate about said pair of first pivot points when said motor is activated.

9. The machine as defined in claim 1, wherein said water system comprises a water pump;

wherein said water system comprises a water heater;

wherein said water system comprises a manifold; and wherein said water system comprises spray heads.

10. The machine as defined in claim 9, wherein said water heater is contained in said interior of said housing;

wherein said water heater is mounted to said bottom wall of said housing;

wherein said water heater is for fluidly communicating with a source of water; and wherein said water heater is for heating the water so as to form heated water.

11. The machine as defined in claim 10, wherein said water pump is contained in said interior of said housing;

wherein said water pump is mounted to said bottom wall of said housing;

wherein said water pump is in fluid communication with said water heater; and wherein said water pump is for pumping the heated water so as to form pumped heated water.

12. The machine as defined in claim 10, wherein said manifold fluidly communicates with said water pump;

wherein said manifold is contained in said interior of said housing;

wherein said manifold extends laterally along said bottom wall of said housing;

wherein said manifold extends along said side walls of said housing; and wherein said manifold is for conducting the pumped heated water so as to form conducted pumped heated water.

13. The machine as defined in claim 12, wherein said spray heads fluidly communicate with said manifold;

wherein said spray heads are operatively connected to said manifold;

wherein said spray heads are contained in said interior of said housing; and wherein said spray heads are for spraying said conducted pumped heated water.

14. The machine as defined in claim 12, wherein said spray heads are rotatively connected to said manifold.

15. The machine as defined in claim 12, wherein said spray heads are fixedly connected to said manifold.

16. The machine as defined in claim 9, wherein said air system comprises an air blower; and wherein said air system comprises a manifold.

17. The machine as defined in claim 16, wherein said air blower is contained in said interior of said housing;

wherein said air blower is mounted to said bottom wall of said housing; and wherein said air blower is for blowing air so as to form blown air.

18. The machine as defined in claim 17, wherein said manifold fluidly communicates with said air blower;

wherein said manifold is contained in said interior of said housing;

wherein said manifold extends laterally along said bottom wall of said housing;

wherein said manifold extends along said side walls of said housing;

wherein said manifold is for conducting said blown air;

wherein said manifold has orifices; and wherein said orifices in said manifold are for exiting the blown air.

19. The machine as defined in claim 16, further comprising a microprocessor;

wherein said microprocessor controls said water heater;

wherein said microprocessor controls said water pump;

wherein said microprocessor controls said motor; and wherein said microprocessor controls said air blower.

20. The machine as defined in claim 1, wherein said frame has a color indicia coding at appropriate positions, facilitating aligning the trays properly when installing the trays in the frame.

* * * * *